US005652562A

United States Patent [19]

Riley

[11] Patent Number: 5,652,562

[45] Date of Patent: Jul. 29, 1997

[54] THERMALLY FUSED RESISTOR HAVING A PORTION OF A SOLDER LOOP THERMALLY CONNECTED TO AN ELECTRICALLY INSULATED PORTION OF AN OUTER SURFACE OF THE RESISTOR

[75] Inventor: Richard E. Riley, Riverside, Calif.

[73] Assignee: Spectrol Electronics Corporation, Ontario, Canada

[21] Appl. No.: 651,833

[22] Filed: May 21, 1996

[51] Int. Cl.[6] ..... H01H 37/76

[52] U.S. Cl. ..... 337/405; 337/401; 337/404

[58] Field of Search ..... 337/166, 185, 337/232, 296, 297, 401–407

[56] References Cited

U.S. PATENT DOCUMENTS

| | | | |
|---|---|---|---|
| 3,609,621 | 9/1971 | Danesi | 337/166 |
| 3,638,083 | 1/1972 | Dornfeld et al. | 361/321.1 |
| 3,931,602 | 1/1976 | Plasko | 337/163 |
| 4,494,104 | 1/1985 | Holmes | 337/403 |
| 4,533,896 | 8/1985 | Belopolsky | 337/232 |
| 4,626,818 | 12/1986 | Hilgers | 337/166 |
| 5,084,691 | 1/1992 | Lester et al. | 337/297 |
| 5,097,247 | 3/1992 | Doerrwaechter | 337/405 |
| 5,192,940 | 3/1993 | Yajima et al. | 338/308 |

*Primary Examiner*—Michael W. Phillips
*Assistant Examiner*—Jayprakash N. Gandhi
*Attorney, Agent, or Firm*—Woodard, Emhardt, Naughton, Moriarty & McNett

[57] ABSTRACT

A thermally fused resistor arrangement wherein a resistor is electrically connected at one end to a first resistor terminal and at an opposite end to a second resistor terminal. A solder loop is provided to make the electrical connection between one end of the resistor and its corresponding resistor terminal. A portion of the solder loop is positioned in contact with an electrically insulated portion of the surface of the resistor, preferably corresponding to the hot spot of the resistor, and a thermally conductive medium is provided to thermally and mechanically attach the solder loop to the electrically insulated portion of the resistor surface. The portion of the solder loop thermally attached to the resistor is operable to melt when the temperature of the resistor increases to within a predefined temperature range, thereby electrically disconnecting the end of the resistor from its corresponding resistor terminal.

21 Claims, 5 Drawing Sheets

THERMALLY FUSED RESISTOR HAVING A PORTION OF A SOLDER LOOP THERMALLY CONNECTED TO AN ELECTRICALLY INSULATED PORTION OF AN OUTER SURFACE OF THE RESISTOR

FIELD OF THE INVENTION

The present invention relates generally to techniques for disconnecting an excessively heated resistor from associated circuitry, and more specifically to such techniques utilizing thermally activated fuses.

BACKGROUND OF THE INVENTION

Many electrical circuits and systems require the use of a power resistor to perform various functions such as, for example, establishing desired voltage and current levels for associated circuitry and/or to divert electrical power from another electrical device. One example of the latter use is in known automotive air conditioning systems which typically utilize a power resistor to control the speed of an air conditioning blower motor. In certain operational modes, the power resistor may be used to divert a considerable amount of power from the blower motor into the incoming air stream. Due to such high power dissipation, the power resistor typically operates at temperatures of between approximately 80–150 degrees C.

In many of the foregoing electrical circuits and systems, potential failure modes exist wherein the power resistor may become excessively hot due to high current flow therethrough. Such excessive heat may cause thermal damage to surrounding circuitry and structures, and possibly result in a fire. To circumvent the possibility of hazardous thermal conditions, such power resistors are typically equipped with a thermally activated fuse designed to open circuit the resistor when the operating temperature thereof rises to some predefined temperature range.

Designers of electrical circuits and systems have heretofore devised a variety of approaches in providing thermally fused electrical components, particularly with respect to film-type electrical components formed on a substrate. One such approach involves the use of a spring loaded metal cantilever connected, typically via solder, between the electrical component and a terminal thereof. When the temperature of the electrical component increases to within a predefined temperature range, the solder attachment between the component and cantilever melts and the spring loaded cantilever pulls away from the component to create an open circuit condition. An example of this approach is shown in U.S. Pat. No. 3,638,083 to Dornfeld, et al.

Although the foregoing approach has been successfully demonstrated, it is inherently unreliable. For example, over time, temperature cycling of the component due to normal operation causes the solder connections to weaken until the spring loaded cantilever pulls away from the component, thereby resulting in an open circuit condition.

Another common approach for providing a thermally activated fuse, particularly for use with a film-type electrical component, is shown in FIG. 1. Referring to FIG. 1, a pair of conductive circuit paths are formed on one side of a substrate 14, and a so-called thick film electrical component 16, which may be a resistor, is formed therebetween in accordance with known techniques. A first component terminal 18 may be electrically connected to circuit path 10 and a second component terminal 20 may be electrically connected to a third conductive circuit path 22 formed adjacent to circuit path 12. A thermally activated fuse element 24 is then electrically connected between circuit paths 12 and 22.

As an alternative to the arrangement of FIG. 1, yet another common approach for providing a thermally activated fuse, particularly suited for use with a film-type electrical component, is shown in FIG. 2. Referring to FIG. 2, a pair of conductive circuit paths 30 and 32 are formed on one side of a substrate 34 with a thick-film electrical component 36 formed therebetween. On the opposite side of substrate 34, a pair of conductive circuit paths 38 and 40 are formed in alignment with circuit paths 30 and 32 respectively. A first component terminal 42 may be electrically connected to circuit paths 30 and 38, and a second component terminal 44 may be electrically connected to circuit paths 32 and 40. A thermally activated fuse element 46 is then electrically connected between circuit paths 38 and 40 opposite electrical component 36.

In the thermally activated fuse approaches shown in FIGS. 1 and 2, fuse elements 24 (FIG. 1) and 46 (FIG. 2) may typically be meltable wires, attachable conductive links designed to fall off, or solder paste designed to reflow, when the operating temperature of the electrical component increases to a predefined temperature range. With each of these known fuse structures, however, several problems are known to exist. For example, in the case of a meltable wire, the wire may melt but may not pull away from circuit paths 38 and 40 sufficiently to break the electrical connection. In the case of attachable conductive links, which are typically attached to circuit paths 38 and 40 via solder, the solder may melt but the conductive link may not come away from the circuit to open circuit the component 36. This problem is compounded if the component 36 is not properly oriented. Finally, in the case of solder paste, such paste tends to lose its liquid component over time, and further due to temperature cycling, so that it may not properly melt and pull away from circuit paths 38 and 40 and open circuit the electrical component as desired. Examples of some of the various thermal fuse arrangements shown and described with respect to FIGS. 1 and 2 are shown in U.S. Pat. No. 4,494,104 to Holmes, U.S. Pat. No. 4,533,896 to Belopolsky and U.S. Pat. No. 5,084,691 to Lester, et al.

Another problem associated with each of the foregoing known thermal fuse arrangements is an inherent inaccuracy in opening the fuse element, and correspondingly open circuiting the electrical component, when the operating temperature of the electrical component reaches an excessive temperature range. As shown in FIGS. 1 and 2, the fuse elements 24 and 46 are positioned remotely from the heat generating component. For example, as shown in FIG. 1 fuse element 24 is positioned adjacent electrical component 16, and as shown in FIG. 2, fuse element 46 and electrical component 36 are positioned on opposite sides of the substrate 34. In each case, regardless of the type of fuse structure used, the electrical component must heat the entire substrate to an excessive temperature range before the fuse opens. In order to do so, the operating temperature of the electrical component, typically a resistor, will therefore rise above the temperature at which the fuse opens. This phenomenon is shown in FIG. 3 which shows a plot of resistor temperature 47 and fuse temperature 48 versus time. As illustrated in FIG. 3, if the fuse element is not in intimate contact with the resistor surface, the maximum temperature of the resistor, $T_{R,MAX}$, increases to a temperature level above the fuse opening temperature, $T_F$, by an amount $\Delta T$ before fuse opening occurs.

The foregoing problem with known thermally fused electrical components which is illustrated in FIG. 3 may have several undesirable effects. For example, the additional resistor temperature increase $\Delta T$ may be sufficient to cause combustion of nearby structures. Further, excessive heating of the entire substrate may cause damage to unrelated circuitry and/or other structure in close proximity thereto.

What is therefore needed is a thermally fused resistor arrangement that reliably open circuits the heat generating resistor when the operating temperature thereof reaches an excessive level. Such a thermal fuse should ideally be placed in intimate thermal contact with the resistor so that it opens as soon as the operating temperature of the resistor reaches a predefined temperature range. An optimum placement of such a thermal fuse should, in fact, correspond to the so-called hot spot of the resistor which, as the term is used herein, is defined as the region of the resistor generating maximum heat.

SUMMARY OF THE INVENTION

Many of the shortcomings of the described in the BACKGROUND section are addressed by the present invention. In accordance with one aspect of the present invention, a thermally fused resistor arrangement comprises a resistor having one end thereof electrically connected to a first resistor terminal, and a solder loop electrically connects an opposite end of the resistor to a second resistor terminal. The resistor has an outer surface, and the arrangement includes means for thermally connecting a portion of the solder loop to an electrically insulated portion of the outer resistor surface.

In accordance with another aspect of the present invention, a method of making a thermally fused resistor comprises the steps of providing a resistor having one end thereof electrically connected to a first resistor terminal, and having an outer surface, electrically connecting a solder loop between an opposite end of the resistor and a second resistor terminal, and thermally connecting a portion of the solder loop to an electrically insulated portion of the outer resistor surface.

In accordance with a further aspect of the present invention, a substrate, and a film-type resistor defined on the substrate, wherein the resistor has one end thereof electrically connected to a first resistor terminal and an opposite end electrically connected to a second resistor terminal, is combined with a thermally activated fuse arrangement for electrically disconnecting the one end of the film-type resistor from the first terminal in response to heat generated by the resistor within a predefined temperature range. The fuse arrangement comprises an electrical insulation layer in contact with at least a portion of an outer surface of the film-type resistor, and a fuse establishing the electrical connection between the one end of the film-type resistor and the first terminal. The fuse further has a portion thereof in thermal contact with a portion of the electrical insulation layer.

One object of the present invention is to provide a thermally fused resistor wherein the thermally activated fuse is positioned in intimate thermal contact with a surface of the resistor.

Another aspect of the present invention is to provide such a thermally fused resistor having the thermally activated fuse positioned in thermal contact with the hot spot of the resistor.

Yet another aspect of the present invention is to provide a thermally fused resistor wherein the thermally activated fuse is a loop of flux core solder attached to a surface of the resistor via thermally conductive epoxy.

These and other objects of the present invention will become more apparent from the following description of the preferred embodiment.

DESCRIPTION OF THE PREFERRED EMBODIMENT

Figure 1:
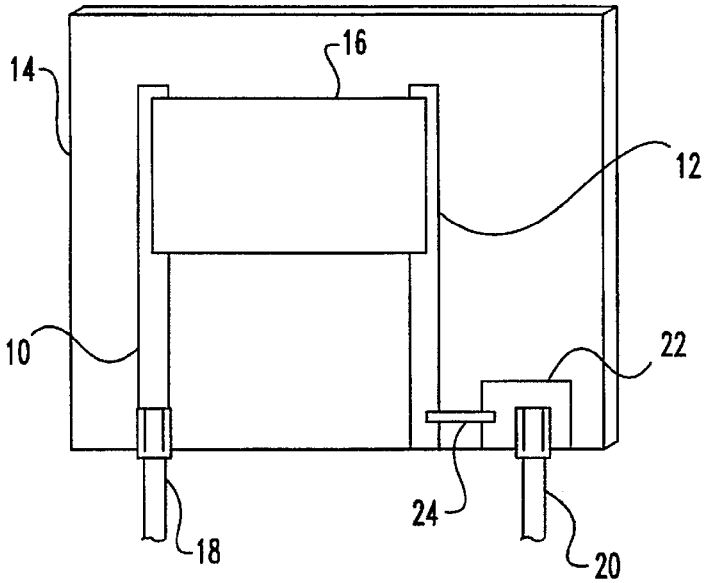
(PRIOR ART) Fig. 1
FIG. 1 is a diagrammatic illustration of a known technique for providing a thermally fused resistor.
Figure 2:
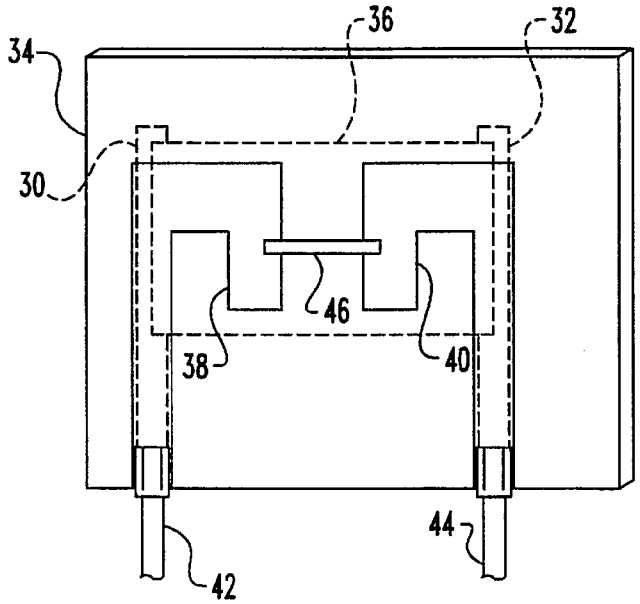
(PRIOR ART) Fig. 2
FIG. 2 is a diagrammatic illustration of another known technique for providing a thermally fused resistor.

For the purposes of promoting an understanding of the principles of the invention, reference will now be made to the embodiments illustrated in the drawings and specific language will be used to describe the same. It will nevertheless be understood that no limitation of the scope of the invention is thereby intended, such alterations and further modifications in the illustrated devices, and such further applications of the principles of the invention as illustrated therein being contemplated as would normally occur to one skilled in the art to which the invention relates.

Figure 4:
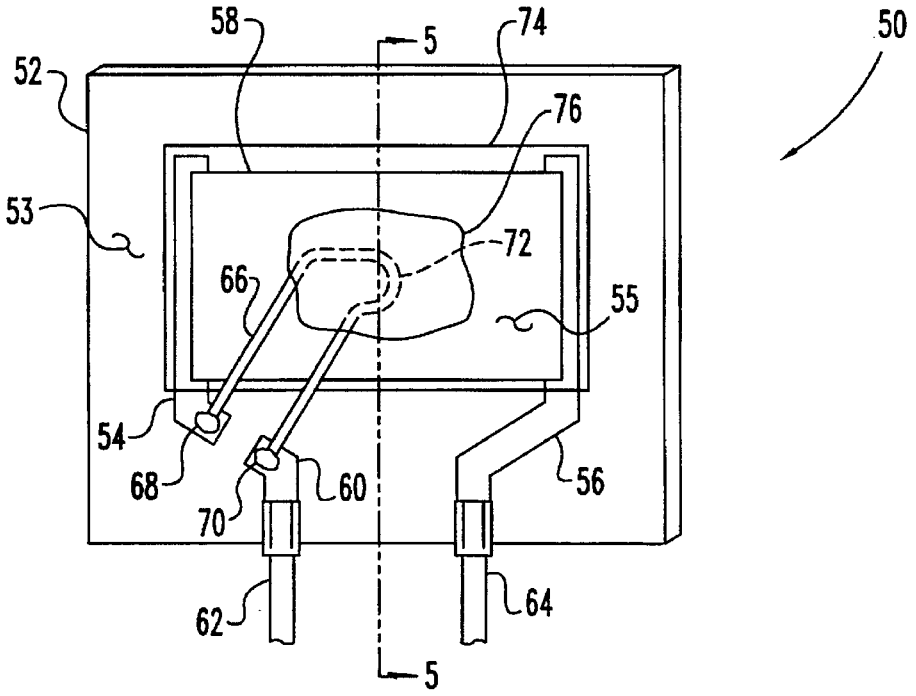
FIG. 4 is a diagrammatic illustration of a preferred embodiment of the thermally fused resistor of the present invention.

Referring now to FIG. 4, a preferred embodiment of the thermally fused resistor 50, in accordance with the present invention, is shown. An electrically insulating substrate 52 may be formed of any material known and used in the electronics industry for printing and attaching electrical circuit elements thereon such as, for example, ceramic alumina. On one surface 53 of substrate 52, electrically conductive circuit paths 54, 56 and 60 are disposed, which may be formed of any known conductive material used in the electronics industry for providing electrical signal paths such as, for example, copper-based compounds and the like. A pair of resistor terminals 62 and 64 are attached, in accordance with known techniques, to circuit paths 60 and 56, respectively.

A thick film resistor 58 is disposed on substrate surface 53, preferably via known film screening or printing techniques, although the present invention contemplates that other known film deposition techniques may be used to provide resistor 58. One end of resistor 58 is electrically connected to electrically conductive circuit path 54, and the opposite end of resistor is electrically connected to electrically conductive circuit path 56. While the thermally activated fuse arrangement of the present invention is shown, and will be discussed in detail hereinafter, in cooperative arrangement with a thick-film resistor 58, it is to be understood that the concepts of the present invention may be used to provide a thermally activated fuse for other known resistor arrangements such as, for example, other film-type resistors and discrete resistors including chip-type resistors, molded resistors and potentiometers to name a few.

Figure 5:
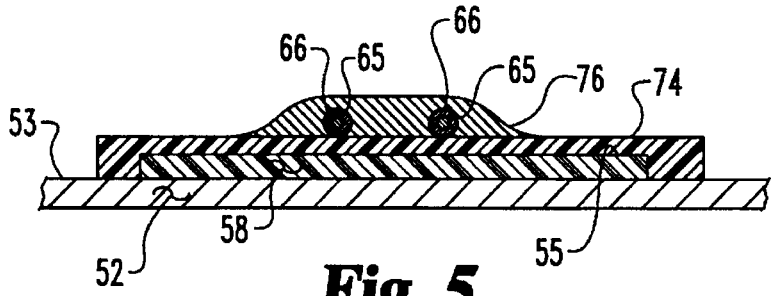
FIG. 5 is a cross-section of the thermally fused resistor of FIG. 4 taken along section lines 5—5.

Referring now to FIGS. 4 and 5, thermally fused resistor 50 is preferably provided with an electrically insulating layer 74 over at least a portion of the exposed resistor surface 55. The electrical insulation layer 74 is included to prevent the thermally activated fuse 66, to be discussed hereinafter, from electrically contacting the active resistor surface 55 and causing an electrical short. Layer 74 may therefore cover the entire resistor surface 55 as shown in FIG. 1, or may cover only an area of the resistor surface 55 which could otherwise contact thermally activated fuse 66. It is to be understood, however, that other resistor types used with the thermally activated fuse arrangement of the present invention may have an electrical insulation layer covering the active resistor area, so that layer 74 may be omitted therefrom.

Preferably, electrical insulation layer 74 is a thin layer, and should be formed of a material capable of forming substantial contact with resistor surface 55 and having high thermal conductivity so as to efficiently conduct heat generated by resistor 58 therethrough. Electrical insulation layer 74 is preferably formed of glass ($SiO_2$), although the present invention contemplates forming layer 74 of other known electrical insulation materials having good thermal conductivity such as, for example, silicon nitride ($Si_3N_4$), polyimide, and known coatings having good or enhanced thermal conductivity.

A thermally activated fuse 66 is electrically connected at one end thereof to circuit path 54, and at an opposite end to circuit path 70, with at least a portion 72 therebetween in contact with electrical insulation layer 74. Fuse 66 is formed, in a preferred embodiment, of a loop of solder having a melting point within a first predefined temperature range, which is electrically connected to circuit paths 54 and 60 via solder connections 68 and 70 respectively, wherein solder connections 68 and 70 are formed of a solder having a melting point within a second predefined temperature range that is slightly less than that of solder loop 66. Those skilled in the art will recognize, however, that fuse 66 may be formed of any suitable material having a melting point within the first temperature range. In any case, when the temperature of resistor 58 increases, in response to current flowing therethrough, to a temperature within the first predefined temperature range, fuse 66 is operable to melt and thereby electrically disconnect circuit path 54 from circuit path 60.

Thermally fused resistor 50 further includes a thermally conductive medium 76 formed in contact with a portion of fuse 66 and electrically insulating layer 74. Thermally conductive medium 76 thereby connects fuse 66 to a portion of the resistor surface 55 thermally, but not electrically. Preferably, thermally conductive medium 76 is formed of a known thermally conductive epoxy, although the present invention contemplates providing medium 76 as any coating or attachment medium having good thermal conductivity, or which has enhance thermal conductivity in accordance with known techniques. It has been determined, through experimentation, that thermally conductive epoxy 76 tends to wet the surfaces of the electrical insulation layer 74 and solder loop 66, thereby producing a consistent fillet of thermally conductive material therebetween.

In operation, a portion 72 of solder loop 66 melts when the temperature of resistor 58 elevates to within the first predefined temperature range, thereby electrically disconnecting circuit path 54 from circuit path 60 and open circuiting resistor 58 between resistor terminals 62 and 64. Since portion 72 of solder loop 66 is encased within thermally conductive medium 76, molten solder retreats within medium 76 to a cooler area of resistor 58, leaving behind a void, or gap, within medium 76. Preferably, solder loop 66 has a flux core 65 which promotes melting of the solder at the appropriate temperature. Further, the resulting void left by the flux core 65 during melting of portion 72 of solder loop 66 creates a significant contraction of the remaining solder metal, which facilitates breaking of the electrical connection between circuit paths 54 and 60. It has been determined through experimentation that using a solder loop 66 having a flux core 65 results in a gap between melted solder loop portions of at least approximately 0.1 inches.

In automotive air conditioning system applications, it is desired that resistor 58 have a maximum operating temperature of approximately 220 degrees C., which has been found to be below the temperature at which normal debris found in air conditioning systems will ignite under typical conditions. In such systems, solder loop 66 is preferably composed of 95% Tin and 5% Silver, which has a melting point within a small range of temperatures about 220 degrees C. It is to be understood, however, that the present invention contemplates that different compositions of solder loop 66 may be used to vary the fusing temperature range. For example, commonly available solders have melting points ranging from approximately 180–250 degrees C., and other materials may be added thereto to extend this range, as is known in the art.

Figure 3:
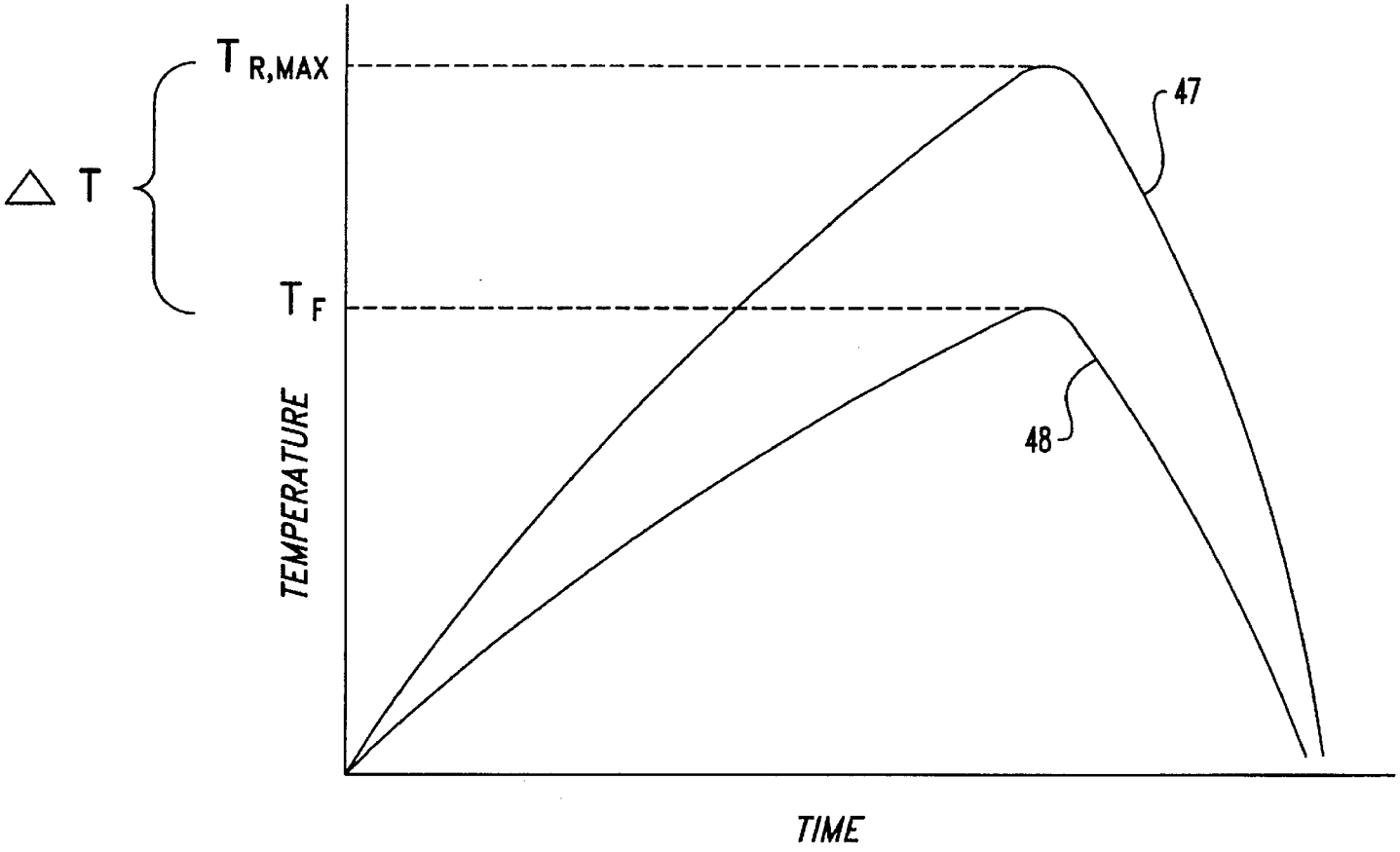
(PRIOR ART) Fig. 3
FIG. 3 is a plot representing the temperature of the resistor compared to the temperature of the thermally activated fuse for either of the thermally fused resistor arrangements of FIGS. 1 and 2.
Figure 6:
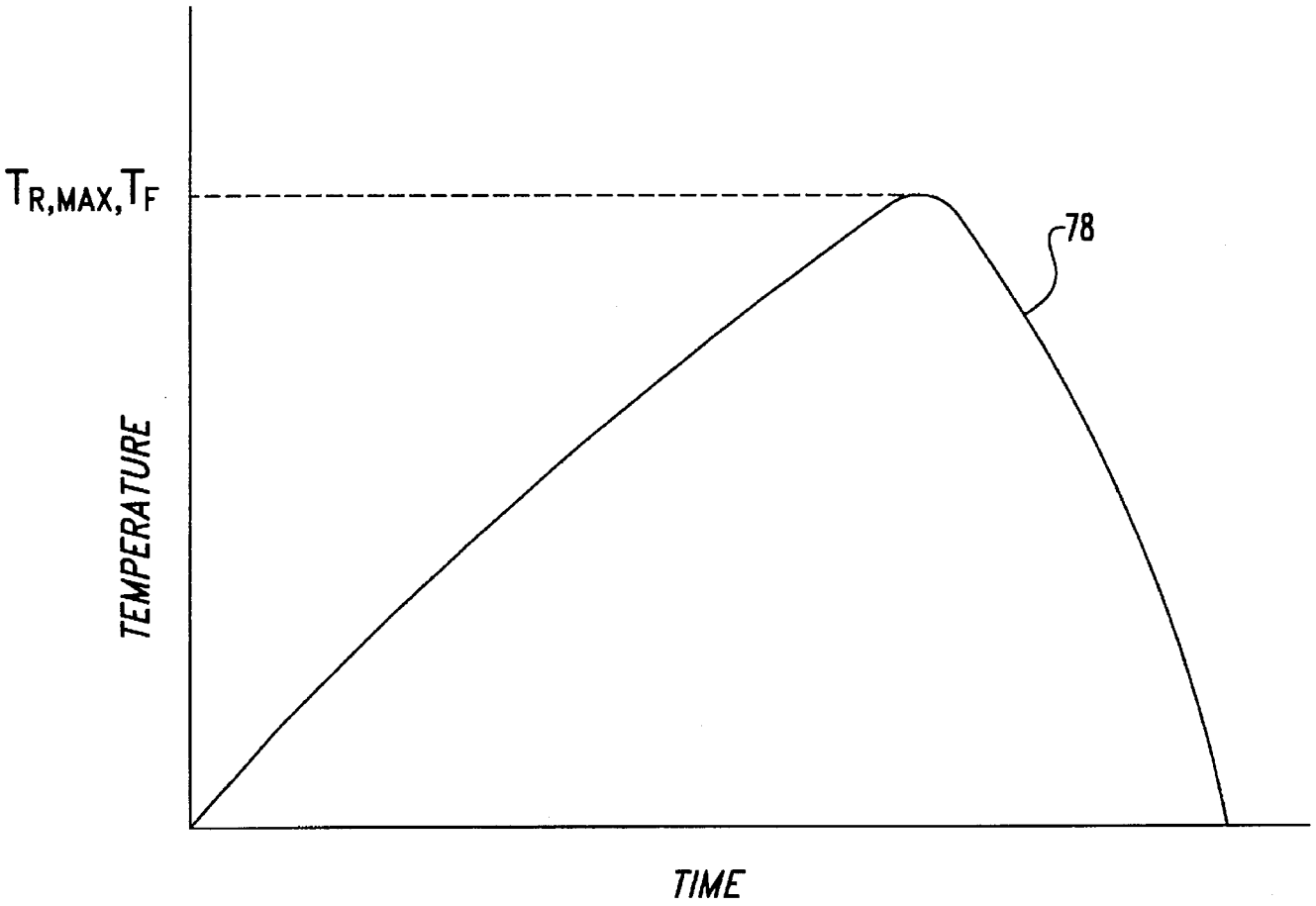
FIG. 6 is a plot representing the temperature of the thermally fused resistor of FIG. 4 as compared to the temperature of the thermally activated fused.

It is further preferable that portion 72 of solder loop 66 is positioned over the "hot spot" of resistor 58, which is defined as a region of the surface 55 of resistor 58 having maximum operating temperature, as compared to other regions of the surface 55 of resistor 58. Such positioning of portion 72 of solder loop 66 promotes a highly accurate "sensing" of the highest operating temperature of resistor 58. In operation, when the hottest portion of the surface 55 of resistor 58 reaches an excessive temperature range, portion 72 of solder loop 66 responds by melting as discussed hereinabove, thereby open circuiting resistor 58 between resistor terminals 62 and 64. This accurate temperature sensing phenomenon is shown in FIG. 6 which shows a plot of the operating temperature 78 of resistor 58 during a thermally activated fuse opening event. In contrast to FIG. 3 which shows a similar illustration for known thermally fused resistor arrangements, it should be noted from FIG. 6 that the maximum operating temperature, $T_{R,MAX}$, of resistor 58 is approximately the same temperature, $T_F$, at which solder loop 66 opens. The thermally activated fuse arrangement of the present invention therefore minimizes any temperature disparity between the maximum operating temperature of resistor 58 and the temperature at which the thermally activated fuse 66 opens, thereby providing a thermal fuse arrangement having accurate temperature operation.

Figure 7:
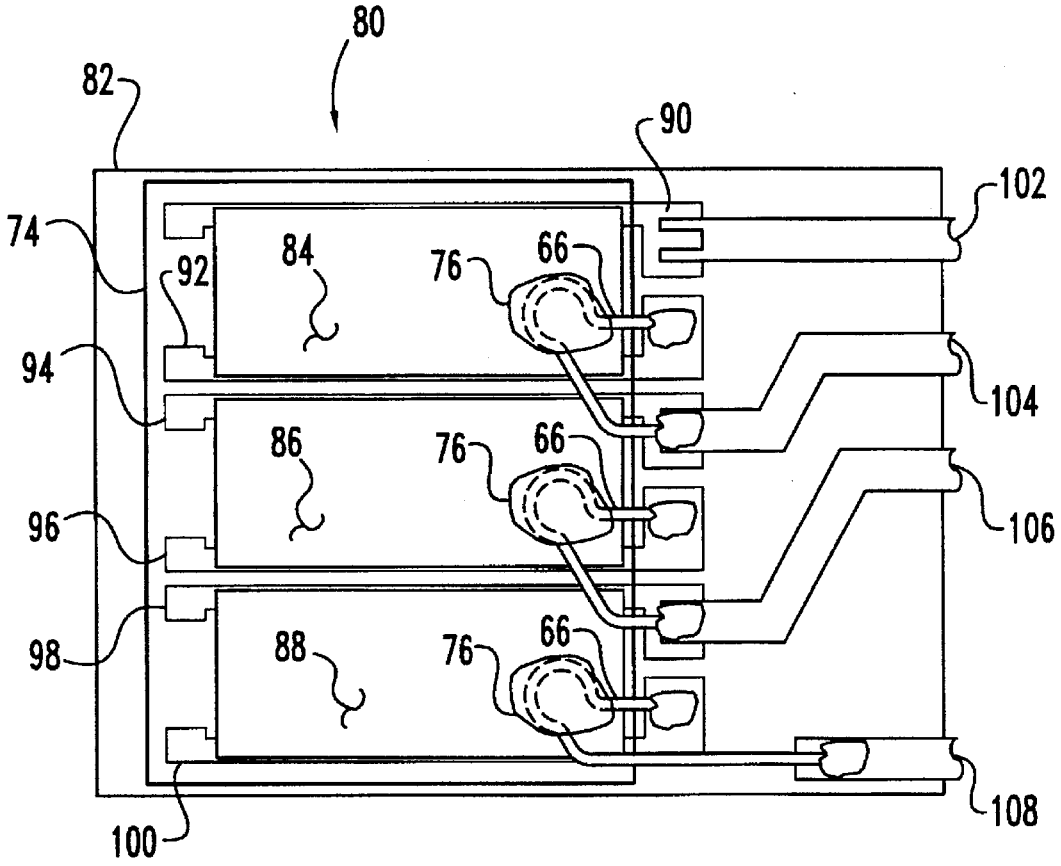
FIG. 7 is a diagrammatic illustration of a preferred embodiment of multiple thermally fused resistors arranged on a single substrate in accordance with the present invention.

Referring now to FIG. 7, a multiple resistor embodiment of a thermally fused resistor arrangement 80, in accordance with the present invention, is shown. Thermally fused resistor arrangement 80 includes a substrate 82 upon which a number of thick-film resistors 84, 86 and 88 are formed in electrical contact with circuit paths 90, 92, 94, 96, 98 and 100 respectively. A number of resistor terminals or circuit paths are electrically connected to circuit paths 90–100 as is known in the art. For example, resistor terminal 102 is connected to circuit path 90, resistor terminal 104 is connected to circuit path 94, resistor terminal 106 is connected to circuit path 98, and resistor terminal 108 is connected to circuit path 100. Resistors 84–88 are electrically connected in a series arrangement between resistor terminals 102 and 108, with each individual resistor having a pair of resistor terminals extending therefrom, although it is be understood that any number of resistors may also be electrically connected in parallel or in any series/parallel combination as is known in the art. Series electrical connections between resistors 84–88 are made using the thermally activated fuse 66 and thermally conductive medium 76 arrangement described hereinabove. Preferably, as shown in FIG. 7, an electrical insulation layer 74 is formed over all resistors 84–88, although layer 74 may be selectively formed over each resistor 84–88 as previously described. The thermally activated fuses 66 are operable as previously described to open circuit the corresponding resistor when the operating temperature of the resistor elevates to within a predefined temperature range.

The present invention is illustrated and described in detail in the drawings and foregoing description, the same is to be considered as illustrative and not restrictive in character, it being understood that only the preferred embodiments have been shown and described and that all changes and modifications that come within the spirit of the invention are desired to be protected.

What is claimed is:

1. A thermally fused resistor arrangement comprising:

a resistor having one end thereof electrically connected to a first resistor terminal, and having an outer surface;

a solder loop electrically connecting an opposite end of said resistor to a second resistor terminal; and means for thermally connecting a portion of said solder loop to an electrically insulated portion of said outer resistor surface.

2. The thermally fused resistor of claim 1 wherein said electrically insulated portion of said outer resistor surface corresponds to a region of said resistor generating maximum heat in response to current flowing therethrough.

3. The thermally fused resistor of claim 1 wherein said solder loop includes a flux core.

4. The thermally fused resistor of claim 3 wherein said solder loop has a melting point within the range of approximately 180–250 degrees C.

5. The thermally fused resistor of claim 1 wherein said means for thermally connecting said portion of said solder loop to said electrically insulated portion of said outer resistor surface is a thermally conductive epoxy.

6. The thermally fused resistor of claim 1 further including means for electrically insulating at least a portion of said outer surface of said resistor.

7. The thermally fused resistor of claim 6 wherein said means for electrically insulating at least a portion of said outer surface of said resistor is an electrically insulating material having high thermal conductivity.

8. The thermally fused resistor of claim 7 wherein said electrically insulating material is glass.

9. The thermally fused resistor of claim 1 further including means for electrically connecting said solder loop to said opposite end of said resistor and to said second resistor terminal.

10. The thermally fused resistor of claim 9 wherein said means for electrically connecting said solder loop to said opposite end of said resistor and to said second resistor terminal includes a solder having a slightly lower melting point than that of said solder loop.

11. The thermally fused resistor of claim 1 wherein said resistor is a film-type resistor.

12. A method of making a thermally fused resistor, the method comprising the steps of:

providing a resistor having one end thereof electrically connected to a first resistor terminal, and having an outer surface;

electrically connecting a solder loop between an opposite end of said resistor and a second resistor terminal; and thermally connecting a portion of said solder loop to an electrically insulated portion of said outer resistor surface.

13. The method of claim 12 wherein said portion of said solder loop is thermally connected to a portion of said outer surface of said resistor corresponding to a region of said resistor generating maximum heat in response to current flowing therethrough.

14. The method of claim 12 wherein said resistor is a film-type resistor;

and wherein the method further includes the following step prior to performing said thermally connecting step:

forming an electrical insulation layer in contact with at least a portion of said outer surface of said resistor.

15. The method of claim 14 wherein said thermally connecting step includes attaching said portion of said solder loop is to a portion of said electrical insulation layer via a thermally conductive epoxy.

16. The method of claim 12 wherein said solder loop is electrically connected to said opposite end of said resistor and to said second resistor terminal via a solder having a slightly lower melting point than that of said solder loop.

17. In combination:

a substrate;

a film-type resistor defined on said substrate, and having one end thereof electrically connected to a first resistor terminal and an opposite end electrically connected to a second resistor terminal; and a thermally activated fuse arrangement for electrically disconnecting said one end of said film-type resistor from said first terminal in response to heat generated by said resistor within a predefined temperature range, said fuse arrangement comprising:

an electrical insulation layer in contact with at least a portion of an outer surface of said film-type resistor; and a fuse establishing said electrical connection between said one end of said film-type resistor and said first terminal, and having a portion thereof in thermal contact with a portion of said electrical insulation layer.

18. The combination of claim 17 further including means for thermally connecting said portion of said fuse to said portion of said electrical insulation layer.

19. The combination of claim 18 wherein said means for thermally connecting said portion of said fuse to said portion of said electrical insulation layer is a thermally conductive epoxy.

20. The combination of claim 19 wherein said fuse is a loop of solder.

21. The combination of claim 20 wherein said loop of solder has a flux core.

* * * * *